US007587968B1

(12) United States Patent
Roberts

(10) Patent No.: US 7,587,968 B1
(45) Date of Patent: Sep. 15, 2009

(54) DICER FOR POTATOES AND THE LIKE

(76) Inventor: Charles J. Roberts, 13692 Broadway, Alden, NY (US) 14004

( * ) Notice: Subject to any disclaimer, the term of this patent is extended or adjusted under 35 U.S.C. 154(b) by 280 days.

(21) Appl. No.: 11/605,187

(22) Filed: Nov. 28, 2006

Related U.S. Application Data

(60) Provisional application No. 60/740,079, filed on Nov. 28, 2005.

(51) Int. Cl.
*B26D 11/00* (2006.01)

(52) U.S. Cl. ..... 83/865; 83/862; 83/932; 83/404.3

(58) Field of Classification Search ..... 83/865, 83/862, 404.2, 932, 651.1, 437.6, 404.3, 83/857, 858
See application file for complete search history.

(56) References Cited

U.S. PATENT DOCUMENTS

| | | | | | |
|---|---|---|---|---|---|
| 273,176 | A * | 2/1883 | Smith | 83/425.3 |
| 874,133 | A * | 12/1907 | Stevens | 83/435.18 |
| 971,624 | A * | 10/1910 | Motter | 83/865 |
| 1,516,724 | A * | 11/1924 | Haase | 83/468.6 |
| 2,200,032 | A * | 5/1940 | Lovelace | 83/128 |
| 2,303,595 | A * | 12/1942 | Young | 83/404.2 |
| 2,353,607 | A * | 7/1944 | Young | 83/404.2 |
| 2,559,554 | A * | 7/1951 | Zahner et al. | 83/563 |
| 2,563,237 | A * | 8/1951 | Grocoff | 83/651.1 |
| 2,611,404 | A * | 9/1952 | Weeks | 83/408 |
| 2,749,955 | A * | 6/1956 | Buechele | 83/426 |
| 2,953,853 | A * | 9/1960 | Tieman | 83/57 |
| 3,115,172 | A * | 12/1963 | Meurer von Inffeld | 83/144 |
| 3,142,905 | A * | 8/1964 | Strasbaugh | 83/620 |
| 3,513,892 | A * | 5/1970 | Genetti | 83/404.3 |
| 3,578,048 | A * | 5/1971 | Von Duyke | 83/569 |
| 3,924,501 | A * | 12/1975 | Cohen et al. | 83/404.3 |
| 4,579,028 | A * | 4/1986 | Neidhardt | 83/109 |
| 4,599,928 | A * | 7/1986 | Oker | 83/581.1 |
| 4,646,602 | A * | 3/1987 | Bleick | 83/408 |
| 5,207,137 | A * | 5/1993 | Baril | 83/167 |
| 5,245,902 | A * | 9/1993 | Pereira | 83/435.19 |
| 5,520,105 | A * | 5/1996 | Healy | 100/98 R |
| 6,053,098 | A * | 4/2000 | Yamamoto | 99/538 |
| 6,098,951 | A * | 8/2000 | McFadden et al. | 248/674 |
| 6,148,704 | A * | 11/2000 | Lewis | 83/167 |
| 6,725,765 | B1 * | 4/2004 | Mendenhall | 99/537 |
| 7,146,896 | B2 * | 12/2006 | Chang | 83/865 |

OTHER PUBLICATIONS

"Stroke" from Dictionary.com retrieved on May 7, 2009.*

* cited by examiner

*Primary Examiner*—Kenneth E. Peterson
*Assistant Examiner*—Sean Michalski
(74) *Attorney, Agent, or Firm*—James C. Simmons

(57) ABSTRACT

A device for dicing a potato or other foodstuff. The foodstuff is pushed through a first assembly of cutters to form foodstuff segments having the shape of french fries. The segments are then pushed through a second assembly of cutters to form foodstuff portions in the shape of cubes. A lever or handle is operated to successively push the foodstuff through the first cutter assembly then push the foodstuff segments through the second cutter assembly.

16 Claims, 3 Drawing Sheets

DICER FOR POTATOES AND THE LIKE

The priority of U.S. provisional application No. 60/740,079, filed Nov. 28, 2005, the disclosure of which is incorporated herein by reference, is hereby claimed.

The present invention relates generally to cutting devices. More particularly, the present invention relates to devices for cutting vegetables or other foodstuffs such as raw potatoes to make french fries or diced potatoes, cheese, and the like.

U.S. Pat. No. 5,207,137, the disclosure of which is incorporated herein by reference, discloses a dicing device for soft boiled potatoes or other work pieces such as raw vegetables or cheese. The device includes a first stage vertical frame having a plurality of horizontal wire cutters through which potatoes or the like are pushed barehandedly to form horizontally sliced potato layers. These layers are then pushed barehandedly by means of a horizontally disposed hand pressure or pusher plate vertically downwardly through a second stage horizontal frame of a mesh of wire cutters to dice the potato slices. The second stage cutter is a complete workable unit in itself so that french fries instead of diced potatoes may be made. When stronger cutter wires are needed for other products, the cutter wires are replaceable.

U.S. Pat. No. 5,245,902, the disclosure of which is incorporated herein by reference, discloses a vegetable (including potato) cutter which includes a base with a through hole spanned by a knife grid. A ram is operable by a lever-type handle manipulated pivotly for movement downwardly to ram the potato downwardly forcing the meat thereof to be sliced by the knife blades of the grid. The grid is attached by screws to the base.

U.S. Pat. No. 2,563,237, the disclosure of which is incorporated herein by reference, discloses a butter cutter including a frame having parallel cutting wires stretched thereacross (and with a cross-wire), and upon which butter is placed for cutting. A pressure plate is superimposed on the butter, and lever-operated means bears on the pressure plate to force the butter through the cutter frame. The frame is interchangeable with other frames for cutting different types of butter.

U.S. Pat. No. 4,646,602, the disclosure of which is incorporated herein by reference, discloses a cheese cutter comprising a frame, a carriage having cheese support members mounted thereon and movable within the frame, a stationary cutter having a plurality of cutting wires mounted therein and extending across the area through which the carriage is moved, and a pivoting cutter having a plurality of cutting wires mounted therein and being pivotal through the area of travel of the carriage. A system is provided for setting the cutter for the desired size of pieces to be cut.

Other patents which may be of interest to the present invention are U.S. Pat. Nos. 273,176 and 3,578,048.

The barehanded pushing of potatoes through the cutters of the above U.S. Pat. No. 5,207,137 would be expected to easily and quickly tire the person's hands with the resulting loss of working efficiency. The machine of U.S. Pat. No. 5,245,902, while suitable for the making of french fries, does not offer a suggestion for the making of diced potatoes.

It is accordingly an object of the present invention to provide an easy and efficient to operate machine for dicing potatoes and the like.

In order to provide such an easy and efficient to operate machine for dicing potatoes and the like, in accordance with the present invention, a dicing device is provided which comprises a mesh of cutters, a first pusher member for pushing a potato or other foodstuff through the cutter mesh to form foodstuff segments, a plurality of elongate spaced cutters, a second pusher member for pushing the segments through the spaced cutters, and lever means for applying force to push the first and second pusher members, the lever means preferably being a lever or handle which is operable to successively push the first pusher member then push the second pusher member, whereby the dicing of a potato may be performed in a single continuous motion of the handle.

The above and other objects, features, and advantages of the present invention will be apparent in the following detailed description of the preferred embodiment thereof when read in conjunction with the appended drawings wherein the same reference numerals denote the same or similar parts throughout the several views.

DETAILED DESCRIPTION OF THE PREFERRED EMBODIMENT

Figure 1:
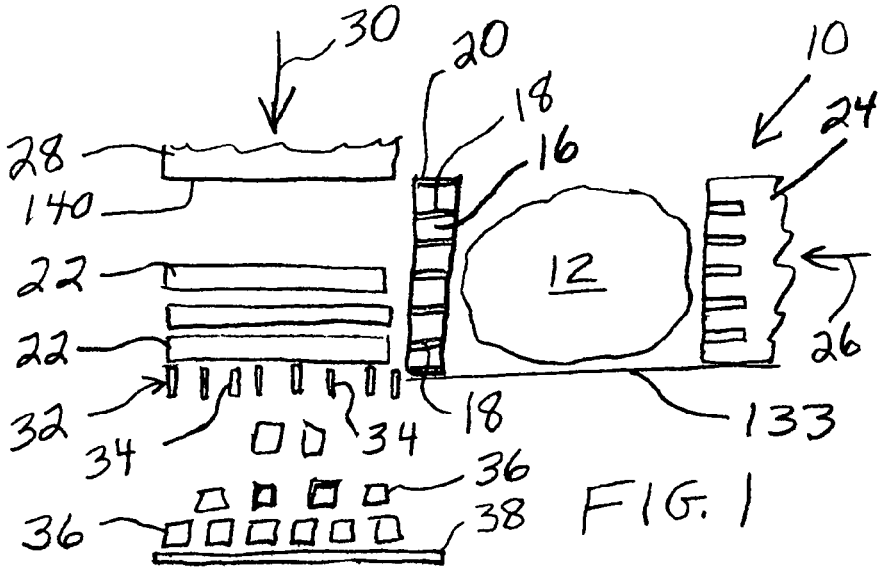
FIG. 1 is a partial schematic view of a device which embodies the present invention, illustrating the dicing of a potato therewith.

Referring to the drawings, there is shown generally at 10 a device for dicing potatoes or other foodstuffs. Except as otherwise noted herein, the various parts of the dicer are composed of stainless steel or other suitable material. The process of dicing a raw potato, illustrated at 12, is best seen in FIG. 1. As illustrated therein, the potato 12 is, in a first stage, pushed horizontally by a first pusher member 24, as illustrated at 26, through a cutter 20 containing a mesh 14 of vertical cutter strips or blades 16 (best illustrated in FIG. 4) and horizontal cutter strips or blades 18, thereby forming a plurality of elongate potato strips or segments 22 in the shape of french fries. If desired, these potato strips 22 can be collected at the end of this first stage and cooked to make french fries. If it is desired to make diced potatoes, then the strips 22 are, in a second stage, pushed vertically downwardly by a second pusher member 28, as illustrated at 30, through a cutter 32 containing a plurality of horizontally spaced elongate cutter strips or blades 34, thereby forming a plurality of cubic-shaped potato portions 36 which may land on a table or counter top 38 or otherwise as suitable. These potato portions 36 may then be cooked to make diced potatoes.

Figure 2:
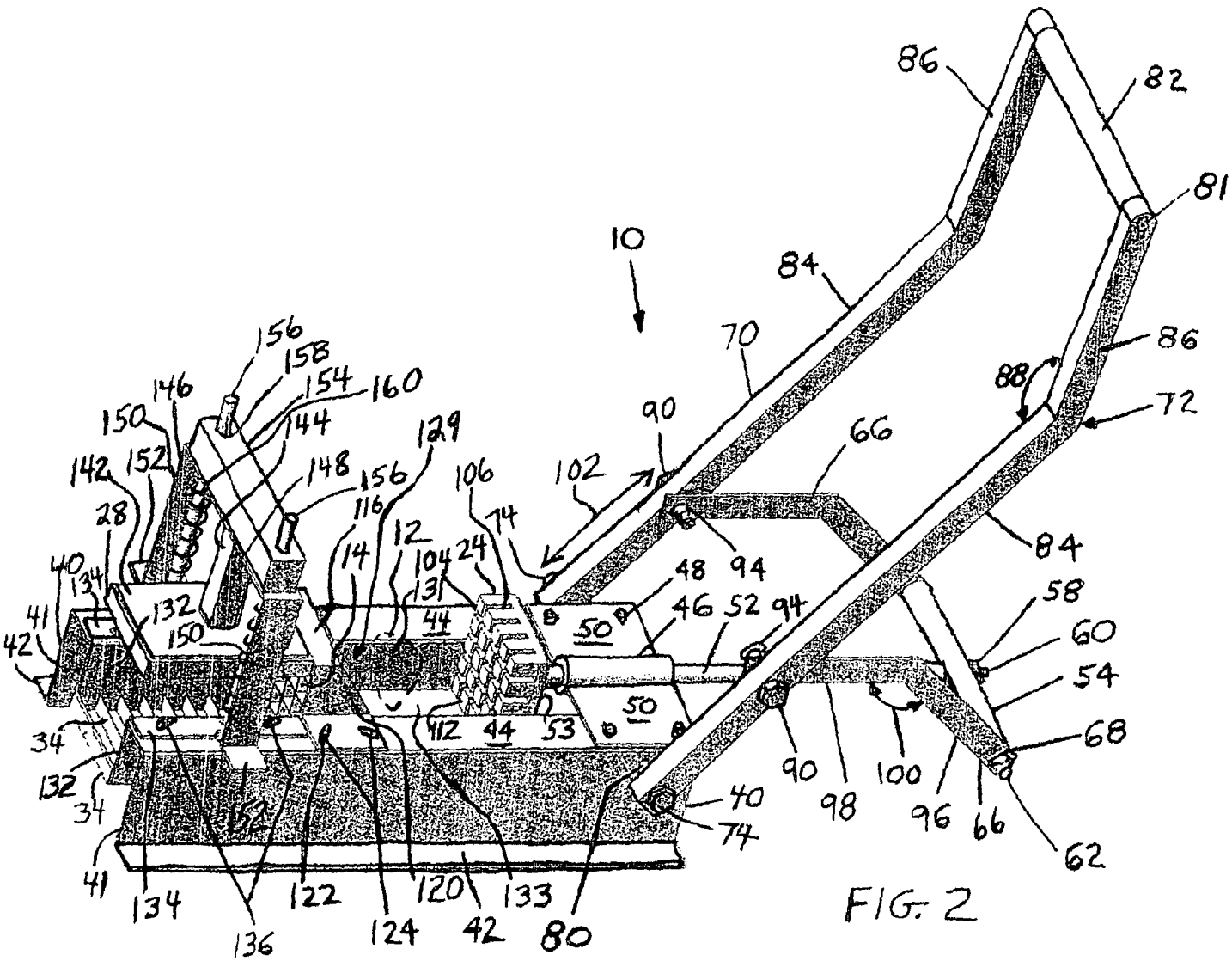
FIG. 2 is a perspective view of the device in position prior to dicing a potato.

Referring to FIG. 2, the dicer 10 comprises a support structure which includes a pair of elongate parallel base members 40 each of which has a vertical wall 41, an outwardly-extending lower flange 42 for supporting the dicer 10 on a table or countertop 38 or the like, and an inwardly-extending upper flange 44. At the rear end of the device 10 is a tubular member 46 positioned midway between the flanges 44 and extending longitudinally of the device 10. A pair of flat plates 50 are welded to or otherwise suitably attached to opposite sides of the tubular member 46 and are attached, such as by fasteners utilizing wing nuts 48, to the flanges 44 respectively. The tubular member 46 as well as the plates 50 which may be integral therewith may be composed of a similar material (discussed hereinafter) as pusher block 24 is composed. The tubular member 46 receives a rod 52 to allow movement of the rod 52 longitudinally of the device 10. The outer end portion 60 of the rod 52 is of reduced diameter and threaded and received in an aperture, illustrated at 56, which extends diametrically through a laterally-extending rod 54 centrally thereof, and a nut 58 threadedly engages the end of the rod 52 extending from the aperture 56 to attach the rod 52 to the rod 54.

The end portions 62 of the rod 54 are of reduced diameter and threaded and are received in apertures, illustrated at 64, in ends respectively of a pair of flat linkage members 66, which are held thereto by nuts 68 which threadedly engage the threaded end portions 62. The threads on the end portions 62 allow tightening of the nuts 68 to such a distance to allow play of the links 66 so that the links may rotate relative to the rod 54.

A handle 70 in the shape of a yoke has a pair of elongate members 72 attached at ends thereof to the rear ends of the base members 40 respectively by suitable means such as bolts 74 received in bushings 80 which are in turn received in apertures in the base members 40 and in the ends of the yoke members 72 and nuts (not shown) threadedly applied thereto so that the handle 70 is free to rotate about the bushings 80. Suitably attached between the other ends of the yoke members 72 is a handle bar 82 to be grasped by a person for operating the handle 70 as hereinafter discussed. Preferably, a soft tubular member (not shown) may be placed over the handle bar 82 so that it spins about the handle bar 82 for ease in handling the handle 70, and the handle bar 82 may be attached to the handle members 72 by screws 81 or otherwise suitably attachable and detachable therefrom to permit removal of the soft tubular member for cleaning. The yoke members 72 extend outwardly of the base members 40 and spaced therefrom and beyond the other or front end of the base members 40. Each of the yoke members 72 (which may be said to be boomerang-shaped) has a first portion 84 which extends from the rear end of the base members 40 over a distance equal approximately to the length of the base members 40 and a second portion 86 which extends at an angle, illustrated at 88, to first portion 84 of the handle bar 82. As seen in FIG. 2, while the first portions 84 are positioned to slant rearwardly in preparation for operating to apply pushing force, the angle 88 is selected so that the second portions 86 extend generally vertically so that the operator can achieve better control and leverage at the beginning of the application of pushing force but not so far that at the end of the stroke, the handle bar 82 contacts the counter top or the like before completion of the stroke. For example, the angle 88 may be about 150 degrees, and the lengths of the yoke member portions 84 and 86 may be about 15½ and 6 inches respectively. However, it should be understood that the handle members 72 may alternatively be straight (i.e., without angle 88) or otherwise suitably shaped.

The links 66 connect the yoke members 72 respectively to the bar 54. The other ends of the links 66 are attached to the yoke members 72 respectively at a point approximately one-third of the length of the respective first portion 84 from the rear end thereof. Attachment of the links 66 to the yoke members 72 is by suitable means such as bolts 90 received in bushings (not shown) which are in turn received in apertures in the yoke members 72 and in apertures in the ends of the links 66 and nuts 94 threadedly applied thereto so as to allow relative free movement rotatably about the bushings between the handle 70 and the links 66.

Each of the links 66 (which may be said to be boomerang-shaped) has a first portion 96 which extends from the rod 54 and a second portion 98 which extends at an angle, illustrated at 100, to first portion 96 of the respective yoke member 72. Thus, the handle 70 is rotatable from the generally vertical position shown in FIG. 2 to the generally horizontal position shown in FIG. 3. The angle 100 is selected to allow horizontal movement of the rod 52 without binding in tubular member 46 and to achieve substantially all of the horizontal movement of the rod 52 during the first part of the stroke of the handle 70 when the handle bar 82 is moving primarily horizontally during the first stage and very little horizontal movement of the rod 52 during the second part of the stroke of the handle 70 during the second stage when the handle bar 82 is moving primarily vertically. For example, the angle 100 may be about 145 degrees, the distance 102 about 4 inches, the length of each of the link portions 96 and 98 about 4 inches, and the stroke length of bar 52 about 6 inches. The rod 52 is received in a friction free bushing (not shown) within tubular member 46 to otherwise prevent the bar 52 from binding. The linkage 66 and 70 is thus constructed to allow, for example, only about 0.030 inch of horizontal movement of the rod 52 during vertical movement of the handle 70 during the second stage of the stroke. Advantageously, such a linkage is provided to conveniently and efficiently successively achieve in a single stroke both the horizontal movement of the first pusher block 24 for the first stage and, after the first stage is completed and the potato strips 22 provided for the second stage, the vertical movement of the second pusher block 28 for the second stage, as discussed in greater detail hereinafter.

The pusher block 24 is composed of ultra-high molecular weight (UHMW) material, Teflon material, or other suitable plastic or other material. The side thereof facing the cutter 20 is generally square to correspond to the cutter 20 whose side facing the block 24 is also generally square. However, it should be understood that the cutter 20 and block 24 may be otherwise suitably shaped. The block 24 is connected centrally thereof to the end of the rod 52 by a plate 53 to which the rod 52 is suitably connected such as, for example, a pin connection to allow removal of the pusher block 24 for cleaning and interchanging for different sizes, etc. For another example, the rod 52 may be welded to plate 53. The plate 53 is attached to the block 24 by suitable fasteners such as, for example, stainless steel cap screws (not shown). The pusher block 24 has in its side facing the cutter 20 a plurality of intersecting horizontal and vertical slots, illustrated at 104 and 106 respectively, suitably sized and spaced (and the block 24 positioned) for receiving the horizontal and vertical cutter strips 18 and 16 respectively of the cutter mesh 14 as the potato 12 is pushed therethrough. The depth of the slots 104 and 106 is substantially equal to the width of the cutter strips 18 and 16 to allow the entire potato 12 to be pushed through the cutter strips 18 and 16. The length of the stroke of rod 52 is selected to allow the slots 104 and 106 to fully receive the cutter strips 18 and 16 respectively during the stroke, with some additional slot depth to keep the cutter strips 18 and 16 from bottoming out. Thus, the front portion of the pusher block 24 is divided into a plurality of squared (or otherwise suitably shaped) portions, illustrated at 112, which fit within the similarly shaped spaces, illustrated at 114 in FIG. 4, between the cutter strips 16 and 18, as the rod 52 is moved forwardly, to cut the potato 12 into the plurality of potato strips 22.

Figure 4:
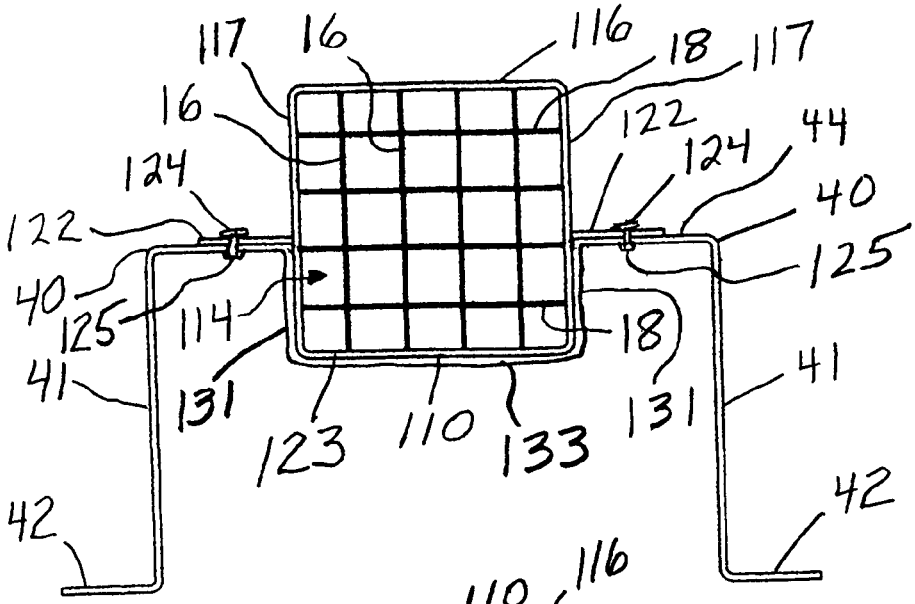
FIG. 4 is an elevation view of a first stage cutter mesh therefor, viewed from forwardly of the device and illustrating its attachment to the device.
Figure 5:
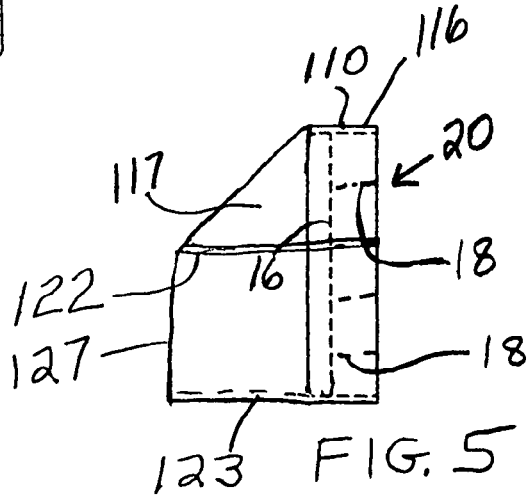
FIG. 5 is a side elevation view of the cutter mesh.

The cutter strips 18 and 16, which are composed of thin (for example, a thickness of about 0.015 to 0.060 inch, preferably about 0.025 inch) strips of stainless steel or other suitable material, are welded or otherwise suitably attached to a perimeter housing member or frame 110, and, at each intersection of a vertical cutter strip 16 with a horizontal cutter strip 18, one of the cutter strips is slotted to accommodate the passage of the other cutter strip. It should of course be understood that the cutter strips need not necessarily be vertical and horizontal but may otherwise be oriented cross-wise so that the foodstuff segments may be suitably formed. As seen in FIG. 5, the perimeter housing 110 has an upper wall 116, a pair of side walls 117, and a bottom wall 123. Each of the side walls 117 flares outwardly toward the device rear to the level of the flanges 44 then drops vertically to bottom wall 123 which accordingly has a greater width than the upper wall 116. The width of the cutter strips 16 and 18 is less than the width of the upper wall 116, the cutter strips 16 and 18 being thus set back from the inlet of the cutter 20 as defined by the upper wall 116. As seen in FIG. 4 for the cutter 20, the lower halves (approximately) of the cutter 20 and the block 24 are disposed below the height of the flanges 44. A pair of flanges 122 are welded or otherwise suitably attached to the perimeter housing side walls 117 respectively to lie on the flanges 44. Each of the flanges 122 is suitably attached to the respective base member flange 44, preferably by means of a pair of screws 125 affixed to the respective base member flange 44 to extend upwardly through apertures in the respective base member flange 44 and the respective flange 122 and wing nuts 124 applied to the screws, to allow the cutter 20 to be easily removed for cleaning and to allow interchange with a cutter of a different size etc.

Beginning flush with the leading (rearward) edge 127 of the perimeter housing 110 and extending to the rear of the device 10, the base members 40 are formed as a single unit interconnected (integrally) by a generally U-shaped trough, illustrated at 129, which serves as a platform for holding the potato 12 or the like in position for being pushed into the first stage cutter 20 for the first stage of cutting thereof. The base members 40 may alternatively be formed as two separate members interconnected by the trough 129. The trough 129 includes vertical walls 131 joined (integrally or otherwise as suitable) to the inner edges of flanges 44 and a lower wall 133 joining (integrally or otherwise as suitable) the lower edges of the vertical walls 131.

The lateral ends of the grid of second stage cutter strips 34, which may be similar to the cutter strips 16 and 18 and which are spaced longitudinally of the base members 40 at the forward end thereof, are welded or otherwise suitably attached to a pair of vertical support plates 132 which extend upwardly therefrom to a pair of flanges 134 which are suitably attached to the base member flanges 44. Preferably, each of the flanges 134 is attached to the respective flange 44 by means of a pair of screws affixed to the respective base member flange 44 to extend upwardly through apertures in the respective base member flange 44 and the respective flange 134 and wing nuts 136 applied to the screws, to allow the second stage cutter 32 to be easily removed for cleaning, to interchange with a cutter of a different size etc., and to allow french fries to be made. The second stage cutter strips 34 are positioned slightly below the level of the first stage cutter 20 and with the rear-most cutter strip 34 slightly forward of the cutter 20 so that the potato strips 22 naturally fall onto the second stage cutter strips 34 as they exit the first stage cutter 20.

The pusher block 28 is disposed over the second stage cutter 32 to be pushed downwardly, as illustrated at 30, by bar 144 for pushing the potato strips 22 through the cutter strips 34 for cubing them, as illustrated by cubed potato portions 36. The pusher block 28 is composed of a similar material as the first stage pusher block 24 is composed and has a generally flat lower surface 140 for engaging and pushing the potato strips 22 through the second stage cutter 32. The upper surface of the pusher block 28 is suitably attached to a plate 142 similarly as the first stage pusher block 24 is attached to plate 53. The vertical bar 144 is suitably attached to the plate 142 centrally thereof, similarly as rod 52 is attached to the plate 53, preferably to allow for removal of the pusher block 28 for cleaning and interchanging for a different size pusher block, etc., and extends upwardly from plate 142. The upper end of bar 144 is welded or otherwise suitably attached to a plate 146 centrally of a horizontal overhanging portion 148 thereof. The horizontal plate portion 148 extends laterally beyond both base member vertical walls 41. The plate 146 is bent or otherwise suitably formed to have a pair of vertical portions 150 extending downwardly from the lateral edges of the horizontal portion 148 and terminating at their lower ends in a pair of outwardly extending flanges 152. Suitably attached (similarly as the pusher block 24 is attached to plate 53) to the horizontal portion 148 and extending laterally generally over the length thereof is a block 154 composed of a similar material as pusher block 24 is composed. Welded or attached by a threaded nut or otherwise suitably attached to each of the base member upper flanges 44 (or to both the respective flange 44 and the respective flange 134) is a vertically extending guide rod 156 which is slidingly received in a clearance hole (not shown) in the horizontal plate portion 148 and a clearance hole, illustrated at 158, in the block 154, i.e., so that the plate 146 and block 154 are movable vertically as guided by the guide rods 156.

Figure 3:
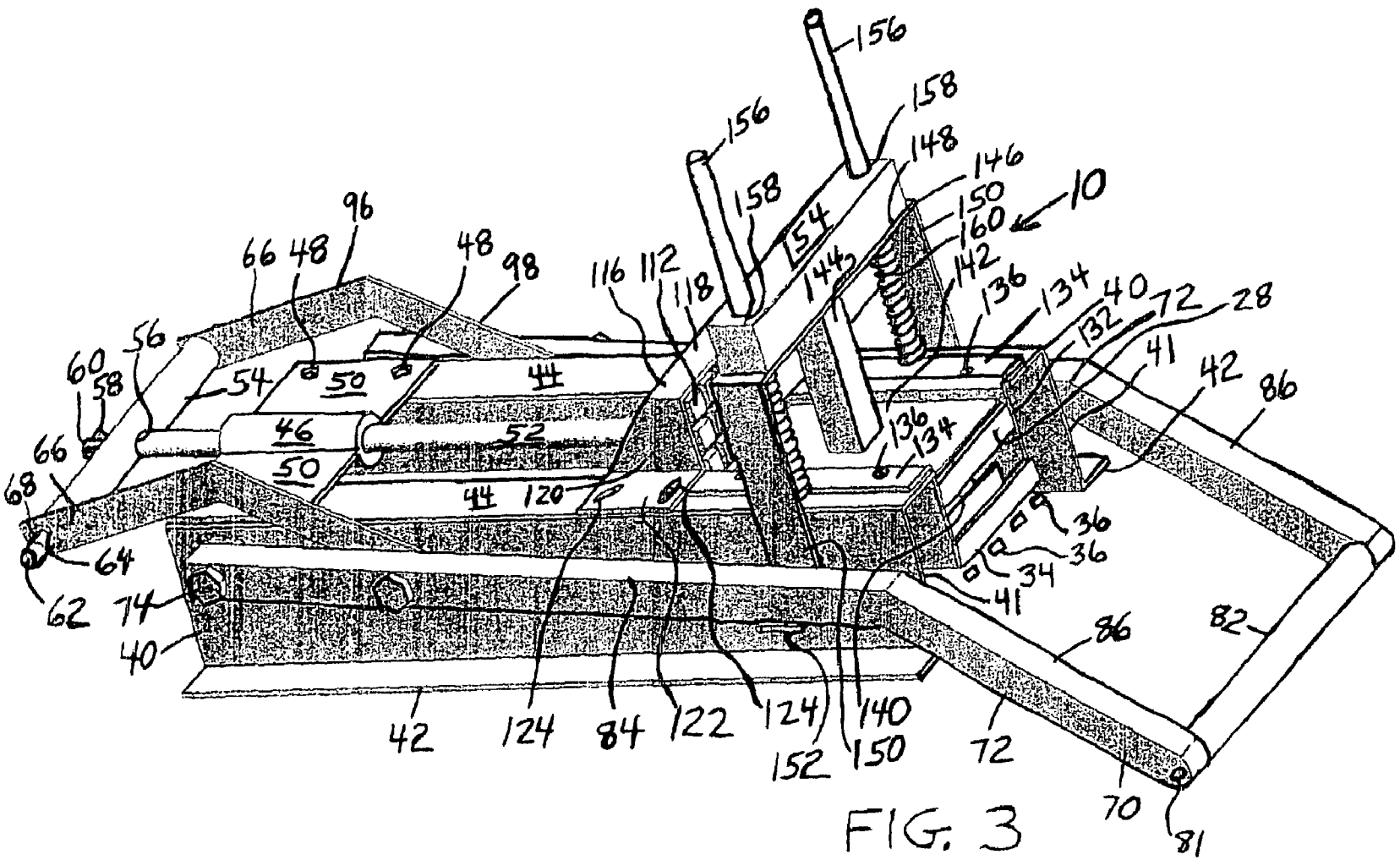
FIG. 3 is a perspective view of the device in position at completion of dicing a potato.

The guide rods 156 are spring-loaded with springs 160 between the base member upper flanges 44 and the plate horizontal portions 148 respectively to urge the bar 154 upwardly, i.e., to the position illustrated in FIG. 2 for the beginning of a stroke. The flanges 152 are suitably positioned to be engaged by the handle members 72 respectively (i.e., the pusher member 28 is engaged by the handle 70) during the latter part of the stroke, as illustrated in FIG. 3. If desired, Teflon members (or members made of other suitable material) may be applied to the upper surfaces of flanges 152 and/or to the handle surfaces which strike the flanges 152 so as to avoid metal-to-metal contact during a stroke. If desired, the upper ends of the guide rods 156 may be suitably tied together or a collar applied thereto to increase rigidity and/or prevent the second stage pusher block assembly from coming off if the dicer is turned upside-down. Thus, the handle members 72 push downwardly on the flanges 152 during the stroke, causing downward movement of the plate 146 and the bar 144 and thus the pusher block 28 against the tension in springs 160 to push the potato strips 22 through the grid of cutter members 34 thus forming cubed potato portions 36, which may then be cooked, from the potato slices. When the handle 70 is returned to the stroke start position (FIG. 2), the pusher block 28 is returned to the upper position (FIG. 2), by the action of the springs 160, in position for another stroke.

The present invention thus allows the two-stage potato cubing to be conducted easily and efficiently by rotating the handle 70 through a single stroke from the position shown in FIG. 2 to the position shown in FIG. 3. During the first part of the stroke, the handle 70 is moved primarily forwardly, pushing the pusher block 24 forwardly through the first stage cutter 20 to form the potato strips 22 and then in sequence moving primarily downwardly to push the flanges 152 and thus the pusher block 28 downwardly (FIG. 3) to force the potato strips 22 through the second stage cutter 32 to form potato cubes for cooking. The handle 70 is then returned to the start position (FIG. 2) by the action of the springs 160 and a new potato 12 inserted to be similarly cubed. The pusher blocks and cutters may be attached, as previously discussed, so that they may be removed for cleaning, for interchanging for different sizes or shapes etc., or for forming french fries instead of cubed potatoes.

It should be understood that, alternatively, the device of the present invention may have two levers for pushing the first and second pusher members respectively.

It should be understood that, while the present invention has been described in detail herein, the invention can be embodied otherwise without departing from the principles thereof. For example, the first and second cutter assemblies may be interchanged. Such other embodiments are meant to come within the scope of the present invention as defined by the appended claims.

What is claimed is:

1. A device for cutting a foodstuff into portions, the device comprising a support structure, a first assembly of cutters attached to said support structure, a first pusher member attached to said support structure for pushing the foodstuff horizontally through said first cutter assembly to form foodstuff segments, a second assembly of cutters attached to said support structure, and a second pusher member attached to said support structure for pushing the foodstuff segments downwardly through said second cutter assembly to form foodstuff portions, the device further comprising a handle pivotally attached to said support structure for movement successively through first and second stages of a single stroke, said handle attached to said first pusher member to apply force to said first pusher member to form the foodstuff segments during the first stage of the single stroke of said handle, and said second pusher member positioned and adapted to be engaged by said handle during the second stage of the single stroke of said handle after the foodstuff segments are formed to apply force to said second pusher member to form the foodstuff portions, wherein said handle is attached to said support structure in a manner such that no movement of said second pusher member is effected by said handle during the first stage of the single stroke and such that substantially no movement of said first pusher member is effected during the second stage of the single stroke.

2. A device according to claim 1 wherein at least one of said first and second cutter assemblies comprises a frame and a mesh of spaced first cutting blades and spaced second cutting blades connected to said frame, said second cutting blades oriented crosswise to said first cutting blades.

3. A device according to claim 1 wherein at least one of said first and second cutter assemblies comprises a plurality of spaced cutting blades.

4. A device according to claim 1 wherein said support structure includes a platform for receiving the foodstuff in position to be pushed through said first cutter assembly, said first cutter assembly comprises a frame and a mesh of horizontally spaced cutting blades and vertically spaced cutting blades connected to said frame, and said second cutter assembly comprises a plurality of spaced horizontal cutting blades positioned to receive thereon the foodstuff segments as they are formed.

5. A device according to claim 1 further comprising at least one spring for effecting biasing movement of said second pusher member upwardly.

6. A device according to claim 1 wherein at least one of said first and second cutter assemblies is detachably attached to said support structure.

7. A device according to claim 1 wherein at least one of said first and second pusher members is detachably attached to said support structure.

8. A device according to claim 1 wherein said first pusher member includes a block for engaging the foodstuff and a rod connected to said block and mounted to said support structure to move horizontally for pushing said block, the device including linkage pivotally connecting said handle to said rod in a manner to effect the pushing of the foodstuff horizontally through said first cutter assembly during the first stage of the single stroke.

9. A device for cutting a foodstuff into portions, the device comprising a support structure, a first assembly of cutters attached to said support structure, a first pusher member attached to said support structure for pushing the foodstuff through the first cutter assembly to form foodstuff segments, a second assembly of cutters attached to said support structure, a second pusher member attached to said support structure for pushing the foodstuff segments through the second cutter assembly to form foodstuff portions, and a lever attached to said support structure and operable for applying force to push both of said first and second pusher members, wherein said lever is a handle pivotally attached to said support structure for movement successively through first and second stages of a single stroke, said handle attached to said first pusher member to apply force to said first pusher member to form the foodstuff segments during the first stage of the single stroke of said handle, and said second pusher member positioned and adapted to be engaged by said handle during the second stage of the single stroke of said handle after the foodstuff segments are formed to apply force to said second pusher member to form the foodstuff portions, the device including means for attaching said handle to said support structure in a manner such that no movement of said second pusher member is effected by said handle during the first stage of the single stroke and in a manner such that substantially no movement of said first pusher member is effected during the second stage of the single stroke.

10. A device according to claim 9 wherein at least one of said first and second cutter assemblies comprises a frame and a mesh of spaced first cutting blades and spaced second cutting blades connected to said frame, said second cutting blades oriented crosswise to said first cutting blades.

11. A device according to claim 9 wherein said support structure includes a platform for receiving the foodstuff in position to be pushed through said first cutter assembly, said first cutter assembly comprises a frame and a mesh of horizontally spaced cutting blades and vertically spaced cutting blades connected to said frame, and said second cutter assembly comprises a plurality of spaced horizontal cutting blades positioned to receive thereon the foodstuff segments as they are formed.

12. A device according to claim 9 further comprising at least one spring for effecting biasing movement of said second pusher member upwardly.

13. A device according to claim 9 wherein at least one of said first and second cutter assemblies is detachably attached to said support structure.

14. A device according to claim 9 wherein at least one of said first and second pusher members is detachably attached to said support structure.

15. A device according to claim 9 wherein said first pusher member includes a block for engaging the foodstuff and a rod connected to said block and mounted to said support structure to move horizontally for pushing said block, and said handle attachment means includes linkage pivotally connecting said handle to said rod in a manner to effect the pushing of the foodstuff horizontally through said first cutter assembly during the first stage of the single stroke.

16. A method for cutting a foodstuff into portions, the method comprises the steps of:

(a) manipulating a lever during a first stage of a single stroke of the lever thereby pushing with a first pusher member attached to a support structure the foodstuff through a first cutter assembly attached to the support structure and onto a second cutter assembly attached to the support structure to form foodstuff segments; and (b) continuing to manipulate the lever during a second stage of the single stroke of the lever thereby pushing with a second pusher member attached to the support structure the foodstuff segments through the second cutter assembly to form foodstuff portions, whereby without moving the second pusher member during the first stage of the single stroke and without substantially moving the first pusher member during the second stage of the single stroke.

* * * * *